US006305333B1

(12) United States Patent
Maruta et al.

(10) Patent No.: US 6,305,333 B1
(45) Date of Patent: Oct. 23, 2001

(54) AIR BLOWER APPARATUS

(75) Inventors: Kazuhiro Maruta; Nobumi Yoshida; Hiroshi Endo, all of Tochigi (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/594,484

(22) Filed: Jun. 16, 2000

Related U.S. Application Data

(62) Division of application No. 09/253,019, filed on Feb. 19, 1999.

(30) Foreign Application Priority Data

Feb. 25, 1998 (JP) ..... 10-43342
Apr. 30, 1998 (JP) ..... 10-120708

(51) Int. Cl.[7] ..... F01P 7/02
(52) U.S. Cl. ..... 123/41.49; 123/41.12; 123/41.11
(58) Field of Search ..... 123/41.49, 41.12, 123/41.11

(56) References Cited

U.S. PATENT DOCUMENTS 5,181,554 * 1/1993 Mita ..... 123/41.49
5,216,983 * 6/1993 Nilson ..... 123/41.49
5,522,457 * 6/1996 Lenz ..... 123/41.49
5,747,883 * 5/1998 Hammer et al. ..... 123/41.49
5,875,836 * 3/1999 Nakamura ..... 123/41.49
5,960,748 * 10/1999 Lewis ..... 123/41.49

* cited by examiner

*Primary Examiner*—Willis R. Wolfe
*Assistant Examiner*—Jason Benton
(74) *Attorney, Agent, or Firm*—Ronald P. Kananen; Rader, Fishman & Grauer

(57) ABSTRACT

Air blower apparatus (20) in which a fan boss (41) at the rotational center portion of a fan (29) has a recessed form. Meanwhile, the central part of the body portion (21) of the air blower apparatus (20), i.e., a boss portion (38), has a projecting form to be housed within the recessed fan boss (41). The central part of the body potion (21), i.e., the boss portion (38), is housed within the recessed fan boss (41) at the rotational center portion of the fan (29), and the rotary shaft (39) of the body portion (21) of the air blower apparatus (20) is mounted on the fan (29).

9 Claims, 8 Drawing Sheets

PRIOR ART

AIR BLOWER APPARATUS

This application is a divisional of copending application Ser. No. 09/253,019, filed Feb. 19, 1999.

BACKGROUND OF THE INVENTION

1. Field of the Invention

The present invention relates to an air blower apparatus, and more particularly to an air blower apparatus that takes up less space.

2. Description of the Related Art

FIG. 8 shows the structure of an air blower apparatus 20 powered by a hydraulic motor 23.

As shown in FIG. 8, a duct 15 is provided in an engine chamber, not shown. A shroud 28 is connected to the duct 15. The body portion 21 of the air blower apparatus 20 is fixed to the inner walls of the shroud 28.

A rotary shaft 39 is provided on the body portion 21 of the air blower apparatus 20. The hydraulic motor 23 is mounted on the body portion 21 of the air blower apparatus 20 so as to connect with the rotary shaft 39. Meanwhile, a fan boss 41' is provided on the rotational center portion of a fan 29. The fan boss 41' is mounted on the rotary shaft 39 of the body portion 21 of the air blower apparatus 20. As a result, the fan 29 is contained within the shroud 28. The air blower apparatus 20 is constituted as above.

With the air blower apparatus 20 shown in FIG. 8, when the hydraulic motor 23 runs, the rotary shaft 29 rotates and thereby the fan 29 rotates. When the fan 29 rotates, devices, not shown, disposed within the engine chamber are blasted with air via the duct 15 and thus cooled.

The air blower apparatus 20 in FIG. 8 is provided within the engine chamber. Meanwhile, in addition to the air blower apparatus 20, various devices such as a radiator, engine, and hydraulic pump driven by the engine are also provided within the engine chamber. Consequently, space for the air lower apparatus 20 is limited within the engine chamber.

For this reason, there is a demand for an air blower apparatus that occupies as little space as possible. In other words, there is a demand for reducing the width of the air blower apparatus 20 in the direction of the rotary shaft 39.

SUMMARY OF THE INVENTION

It is an object of the present invention to reduce the space required by air blower apparatus by reducing the width of the air blower apparatus in the direction of its rotary shaft.

In order to achieve the abovementioned object, the first invention of the present invention is an air blower apparatus comprising a hydraulic motor and a body portion provided with a rotary shaft, the hydraulic motor being mounted on the rotary shaft, the rotary shaft on which the hydraulic motor is mounted being mounted on a fan, whereby the fan is rotated by driving the hydraulic motor, wherein the fan and the body portion of the air blower apparatus are disposed so as to partially overlap each other in the direction of the rotary shaft, making width of the air blower apparatus in the direction of the rotary shaft less than total of width of the body portion of the air blower apparatus in the direction of the rotary shaft and width of the fan in the direction of the rotary shaft.

The first invention is explained with reference to FIG. 2.

With the first invention, the fan 29 and body portion 21 of the air blower apparatus 20 are disposed so as to partially overlap in the direction of the rotary shaft. The width of the air blower apparatus 20 in the direction of the rotary shaft is therefore less than the total of the width of the body portion 21 of the air blower apparatus 20 in the direction of the rotary shaft and the width W of the fan 29 in the direction of the rotary shaft.

With the first invention, the width of the air blower apparatus 20 in the direction of the rotary shaft becomes small and the space occupied by the air blower apparatus 20 can be made small, because the fan 29 and body portion 21 of the air blower apparatus 20 are disposed so as to partially overlap in the direction of the rotary shaft.

In order to achieve the abovementioned object, the second invention of the present invention is an air blower apparatus comprising a hydraulic motor and a body portion provided with a rotary shaft, the hydraulic motor being mounted on a rotary shaft of the body portion, the rotary shaft of the body portion which the hydraulic motor is mounted on being mounted on a fan, and the fan being rotated by driving the hydraulic motor, wherein a rotational center portion of the fan is formed with a recess; and a substantially central portion of the body portion of the air blower apparatus is formed into a projection to be housed in the recess, and the rotary shaft of the body portion of the air blower apparatus is mounted on the fan by housing the projection of the body portion of the air blower apparatus in the recess of the fan.

The second invention is explained with reference to FIG. 2.

With the second invention, the fan boss 41 in the rotational center portion of the fan 29 is formed to have a recess. Meanwhile, the substantially central part, that is, a boss 38, of the body portion 21 of the air blower apparatus 20 is formed to have a projection that is housed in the recessed fan boss 41. The projecting boss 38 of the body portion 21 of the air blower apparatus 20 is housed within the recessed fan boss 41 in the rotational center portion of the fan 29 and thereby the rotary shaft 39 of the body portion 21 of the air blower apparatus 20 is mounted on the fan 29. The air blower apparatus 20 is constituted in this way.

With the second invention, the width of the air blower apparatus 20 in the direction of the rotary shaft 39 can be reduced because the boss 38 of the body portion 21 of the air blower apparatus 20 is contained within the fan boss 41 of the fan 29. The space occupied by the air blower apparatus 20 can be made small because of the small width of the air blower apparatus 20 in the direction of the rotary shaft.

For the third invention, in the air blowing apparatus according to the second invention, the abovementioned hydraulic motor is mounted substantially in the central part of the body portion of the air blower apparatus.

The third invention is explained with reference to FIG. 2.

With the third invention, the hydraulic motor 23 is mounted substantially in the central part of the body portion 21 of the air blower apparatus 20.

Consequently, with the third invention, all or part of the body portion 21 of the air blower apparatus 20, wherein the hydraulic motor 23 is mounted, is contained within the fan boss 41 of the fan 29. As a result, the width of the air blower apparatus 20 in the direction of the rotary shaft 39 can be made small. Because the width of the air blower apparatus 20 in the direction of the rotary shaft becomes small, the space occupied by the air blower apparatus 20 also can be made small.

For the fourth invention, in the air blowing apparatus according to the second invention, the abovementioned hydraulic motor is mounted on the body portion of the air blower apparatus, so as to lie substantially within the total width of the body portion of the air blower apparatus in the direction of the rotary shaft and the width of the abovementioned fan in the direction of the rotary shaft, when the rotary shaft of the body portion of the air blower apparatus is mounted on the abovementioned fan.

The fourth invention is explained with reference to FIG. 2.

With the fourth invention, the hydraulic motor 23 is mounted on the body portion 21 of the air blower apparatus 20, so as to lie substantially within the total width of the width of the body portion 21 of the air blower apparatus 20 in the direction of the rotary shaft and the width W of the fan 29 in the direction of the rotary shaft, when the rotary shaft 39 of the body portion 21 of the air blower apparatus 20 is mounted on the fan 29.

With the fourth invention, the necessary space can be further reduced because the hydraulic motor 23 is mounted on the body portion 21 of the air blower apparatus 20 so as to lie substantially within the same.

For the fifth invention, in the air blowing apparatus according to the second invention, a power transmission device is provided on the body portion of the air blower apparatus so as to transmit the power of the abovementioned hydraulic motor to the abovementioned rotary shaft.

The fifth invention is explained with reference to FIG. 6.

With the fifth invention, a power transmission device 57A, for transmitting the power of the hydraulic motor 23 to the rotary shaft 39, is provided on the body portion 21 of the air blower apparatus 20.

With the fifth invention, the necessary space can be made small even with the addition of a power transmission device such as a transmission.

For the sixth invention, in the air blowing apparatus according to the second invention, the abovementioned fan is contained within a shroud, while the body portion of the air blower apparatus is fixed to the inner walls of the shroud.

The sixth invention is explained with reference to FIG. 2.

With the sixth invention, the fan 29 is contained within the shroud 28 and the body portion 21 of the air blower apparatus 20 is fixed to the inner walls of the shroud 28. This means that the fan 29 can be caused to rotate within the shroud 28, and therefore the blowing efficiency of the air blower apparatus 20 can be improved. Further, because the body portion 21 of the air blower apparatus 20 is fixed to the inner walls of the shroud 28, the air blower apparatus 20 can be securely fixed within the shroud 28.

In order to achieve the abovementioned object, the seventh invention of the present invention is an air blower apparatus comprising a hydraulic motor and a body portion provided with a power transmission device for transmitting power of the hydraulic motor to a rotary shaft of the body portion, the hydraulic motor being mounted on the power transmission device; the rotary shaft of the body portion which the hydraulic motor is mounted on being mounted on a fan, whereby the fan is rotated by driving the hydraulic motor, wherein a rotational center portion of the fan is formed with a recess; a part of the body portion of the air blower apparatus, where the power transmission device is provided, is formed into a projection to be housed in the recess, and the rotary shaft of the body portion of the air blower apparatus is mounted on the fan by housing the projection of the body portion of the air blower apparatus within the recess of the fan.

The seventh invention is explained with reference to FIG. 6.

With the seventh invention, the fan boss 41 in the rotational center portion of the fan 29 is formed into a recess. Meanwhile, the portion of the body portion 21 of the air blower apparatus 20 where the power transmission device 57A is provided, in effect the power transmission device 57A and boss portion 38, is formed into a projection that is housed in the recessed fan boss 41. The projecting power transmission device 57A and boss portion 38 of the body portion 21 of the air blower apparatus 20 are therefore contained within the recessed fan boss 41 in the rotational center portion of the fan 29, and thereby the rotary shaft 39 of the body portion 21 of the air blower apparatus 20 is mounted on the fan 29. The air blower apparatus 20 is constituted in this way.

With the seventh invention, the power transmission device 57A and boss portion 38 of the body portion 21 of the air blower apparatus 20 are housed within the fan boss 41 of the fan 29. As a result, the width of the air blower apparatus 20 in the direction of the rotary shaft 39 can be made small. In effect, the width of the air blower apparatus 20 in the direction of the rotary shaft 39 can be made small because the power transmission device 57A such as a transmission usually requiring much space can be housed within the fan boss 41. Since the width of the air blower apparatus 20 in the direction of the rotary shaft becomes small, the space occupied by the air blower apparatus 20 also can be made small.

DESCRIPTION OF THE PREFERRED EMBODIMENTS

A first embodiment of the air blower apparatus according to the present invention is explained below.

Figure 1:
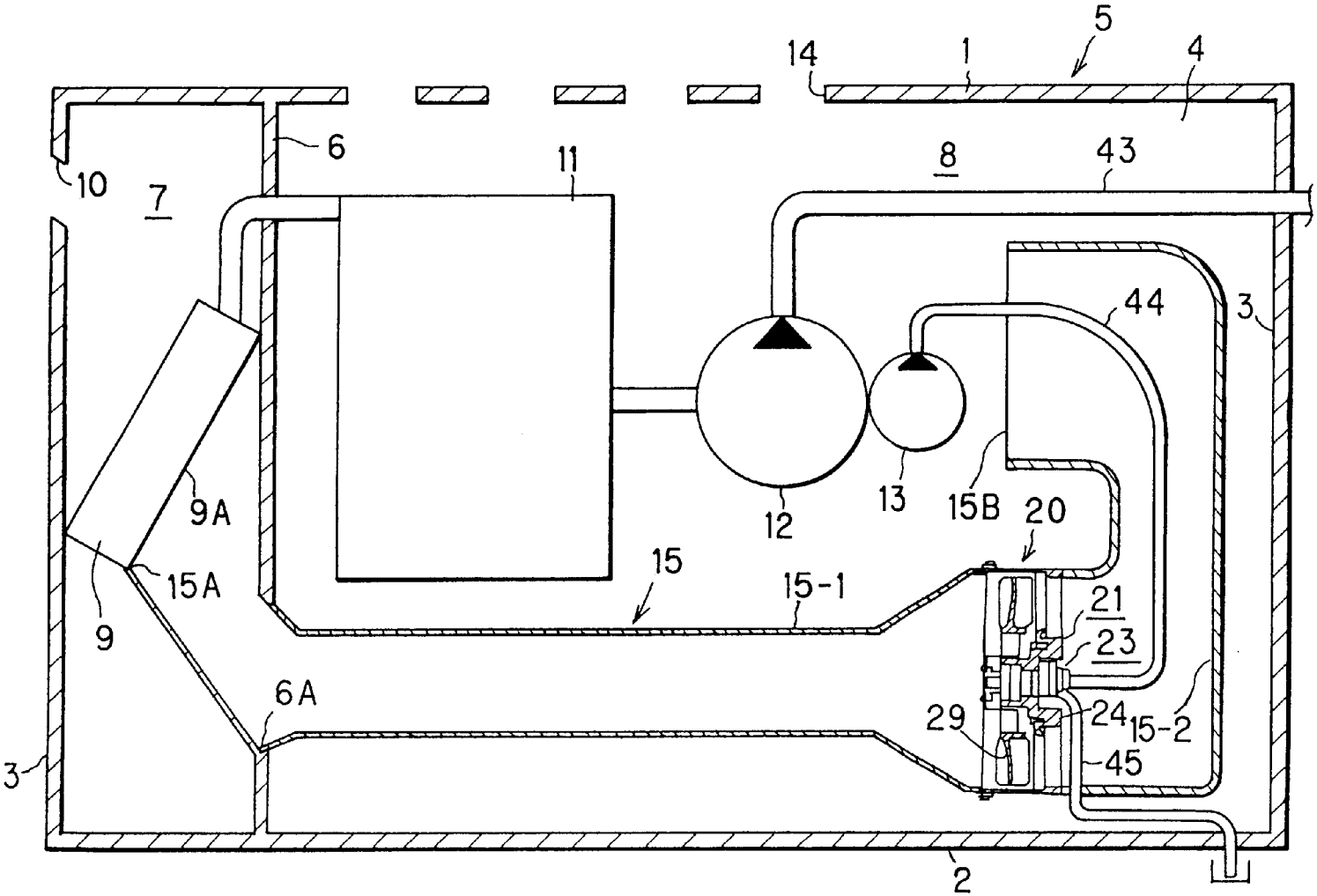
FIG. 1 shows the entire configuration including an air blower apparatus of the present invention.

FIG. 1 shows a cross sectional view of the entire configuration including the air blower apparatus according to the present invention. The apparatus shown in FIG. 1 would be mounted in construction machinery or industrial vehicles, for example.

As shown in FIG. 1, a box-shaped noise proofing chamber 5 is formed of noise proofing walls 1, 2, 3 and 4. The noise proofing walls 1, 2, 3, and 4 are formed of soundproof materials. Glass wool, vibration proof rubber panels, or Helmholtz resonators, for example, can be used as the soundproof materials.

The interior of the noise proofing chamber 5 is divided into a radiator chamber 7 and engine chamber 8 by means of a soundproof partition wall 6. Accordingly, the radiator chamber 7 and engine chamber 8 are made soundproof by the noise proofing walls 1, 2, 3, 4, and 5.

A radiator 9 is disposed within the radiator chamber 7. An air intake opening 10 is formed in the noise proofing wall 3 constituting the radiator chamber 7.

An engine 11, a hydraulic pump 12 driven by the engine 11, and a hydraulic pump 13 for the air blower apparatus that is driven by the engine 11 are disposed within the engine chamber 8. An air exhaust outlet 14 is formed in the noise proofing wall 1 constituting the engine chamber 8. A generator, compressor, or the like can be used instead of the hydraulic pumps 12, 13.

Cooling water for the engine 11 is circulated within the radiator 9 by a cooling pump, not shown.

An inlet port for the hydraulic pump 12 and an inlet port for the hydraulic pump 13 of the air blower apparatus are connected to a tank outside of the noise proofing chamber 5 by pipe lines, not shown.

The radiator 9 communicates with the engine 11, and hydraulic pumps 12, 13 via a duct 15.

Specifically, an opening 15A at one end of the duct 15 is attached to an air outlet side 9A of the radiator 9. The duct 15 passes through a hole 6A in the soundproof partition wall 6. An opening 15B at the other end of the duct 15 opposes to the engine 11 and hydraulic pumps 12, 13.

The duct 15 comprises a first duct case 15-1 and a second duct case 15-2. The second duct case 15-2 has a substantially U-shape. The first duct case 15-1 and the second duct case 15-2 are connected by a shroud 28 within the interior of the engine chamber 8. The air blower apparatus 20 is provided at the location where the first duct case 15-1 and second duct case 15-2 are connected.

The air blower apparatus 20 is constituted of a body portion 21, a fan 29, and a hydraulic motor 23.

The construction of the air blower apparatus 20 is explained below with reference to FIGS. 2, 3, and 4.

Figure 2:
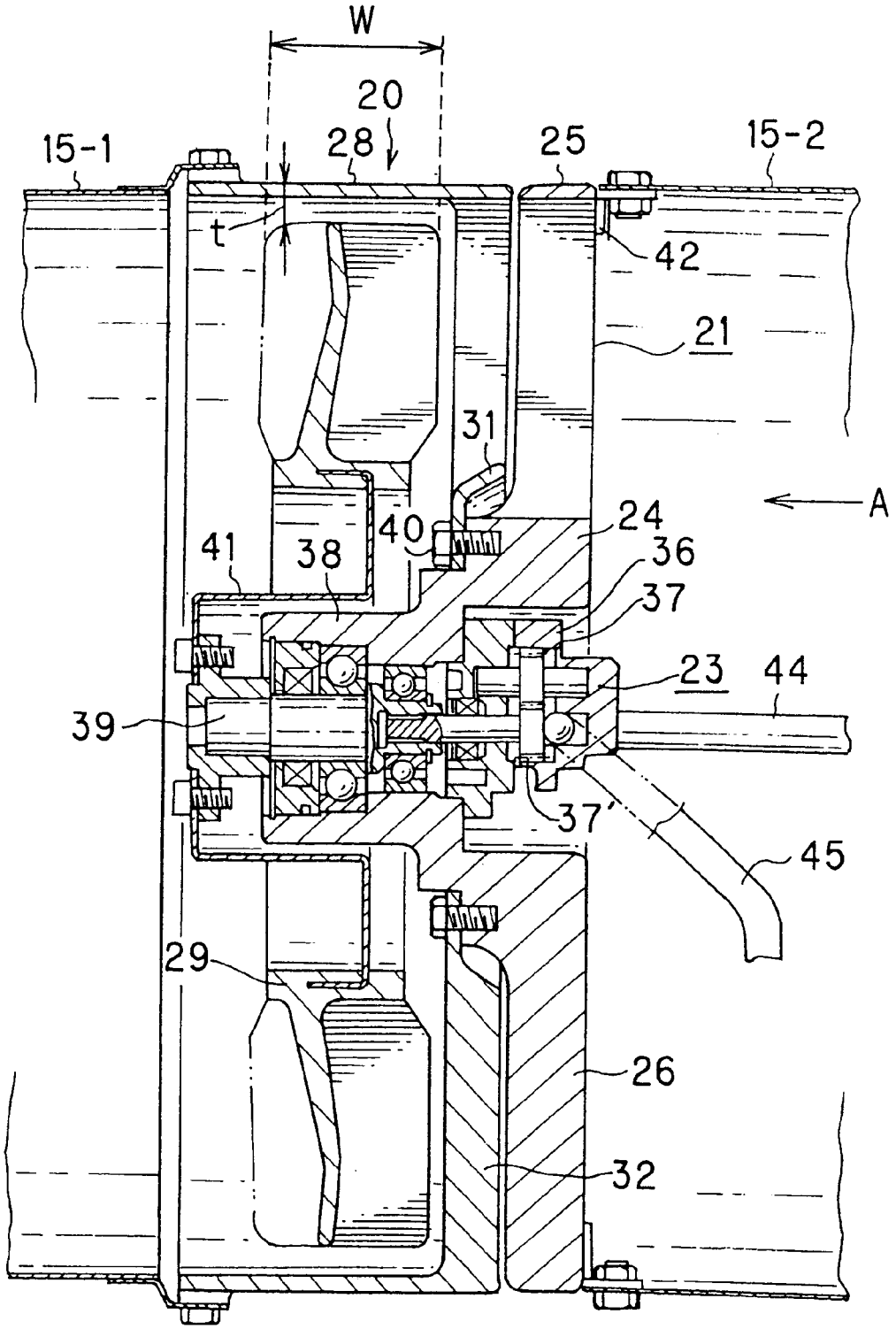
FIG. 2 shows a cross sectional view of the air blower apparatus according to the first embodiment.

FIG. 2 is a cross sectional view of the air blower apparatus 20.

As shown in FIG. 2, the cylindrical shroud 28 is connected to the first duct case 15-1.

Figure 4:
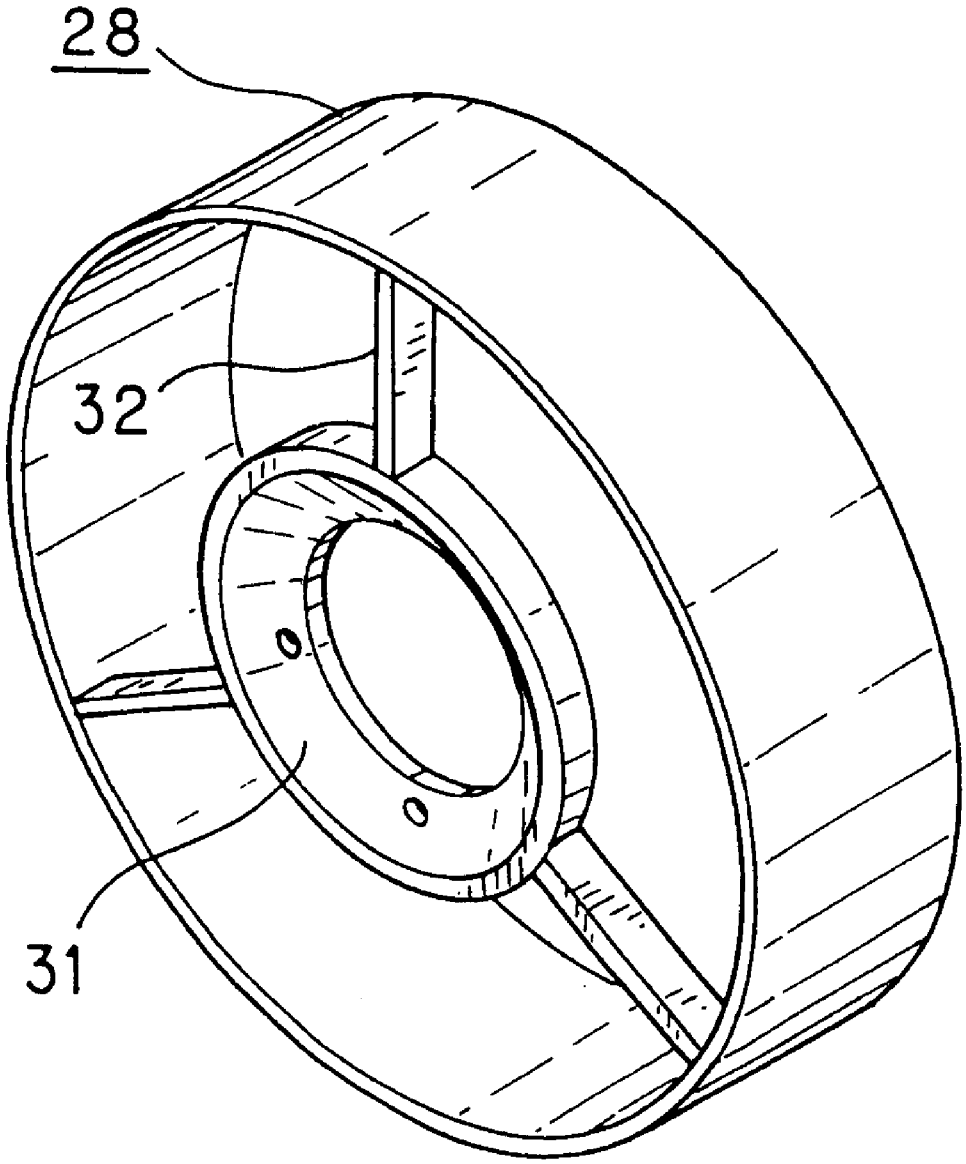
FIG. 4 is a perspective view of a shroud shown in FIG. 2.

FIG. 4 is a perspective view of the shroud 28 in FIG. 2.

As shown in FIG. 4, a plurality of radial ribs 32 is provided on the inside of the shroud 28. Furthermore, a mounting plate 31 connected to a plurality of ribs 32 is provided in the shaft center of the shroud 28. The fan 29 is housed within the shroud 28.

Figure 3:
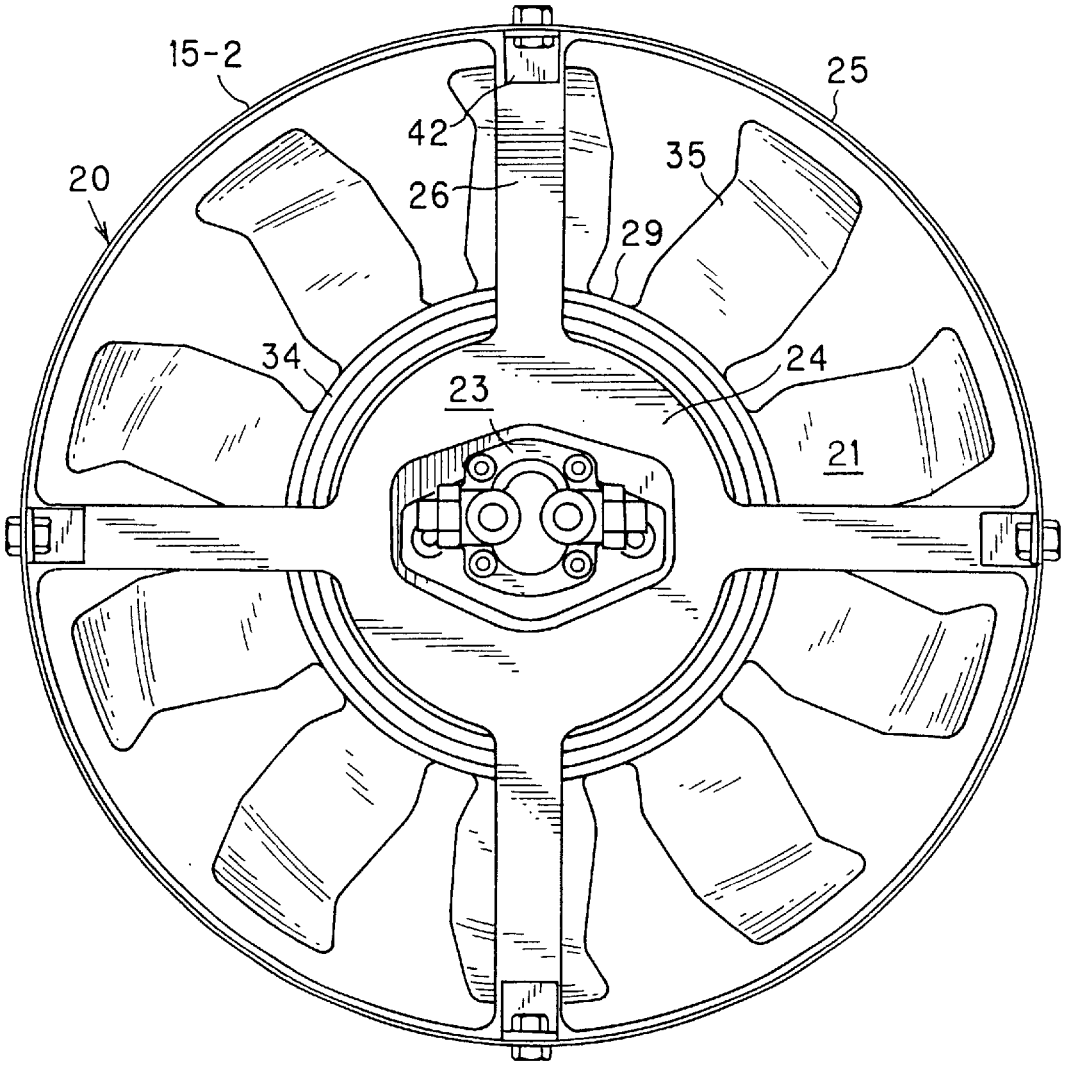
FIG. 3 shows the air blower apparatus in FIG. 2 as viewed in the direction of arrow A.

FIG. 3 is a view of FIG. 2 as seen in the direction of arrow A.

As shown in FIG. 3, the body portion 21 of the air blower apparatus 20 is constituted with a disk-shaped inside plate 24 and a ring-shaped outside plate 25 connected integrally by a plurality of radial ribs 26. The second duct case 15-2 is connected via a bracket 42 to the outside plate 25 of the body portion 21 of the air blower apparatus 20.

The inside plate 24 of the body portion 21 of the air blower apparatus 20 is fixed by the bolts 40 to a mounting plate 31 of the shroud 28. As above, the body portion 21 of the air blower apparatus 20 is fixed to the inner walls of the shroud 28.

A fan boss 41 is provided on the rotational center portion of the fan 29. The fan boss 41 projects in the form of a cylinder toward the first duct case 15-1 side while it is recessed towards the second duct case 15-2 side.

The hydraulic motor 23 is mounted on the central portion of the inside plate 24 of the body portion 21 of the air blower apparatus 20. The hydraulic motor 23 is mounted on the body portion 21 from the second duct case 15-2 side.

The hydraulic motor 23 is a geared hydraulic motor having a pair of gears 37, 37' provided rotatably within the housing 36. The discharge pressure oil from the hydraulic pump 13 for the air blower apparatus 20 is supplied via a pipe line 44 to the interlocking portions of the gears 37, 37' of the hydraulic motor 23. The hydraulic motor 23 is rotated thereby. The returning pressure oil of the hydraulic motor 23 is returned to the tank outside the noise proofing chamber 5 via a pipe line 45.

A boss portion 38 is formed on the inside plate 24. The boss portion 38 is formed to project towards the first duct case 15-1 side so as to be housed within the recessed fan boss 41. The boss portion 38 is formed on the central portion of the body portion 21 of the air blower apparatus 20 where the hydraulic motor 23 is mounted. In other words, the output shaft, or the rotary shaft of the gear 37', of the hydraulic motor 23 is provided in the center of the boss portion 38.

The rotary shaft 39 of the fan 29 is provided rotatably at the center of the boss portion 38. In effect, the rotary shaft 39 is coaxial to the rotary shaft of one gear 37' of the hydraulic motor 23. The rotary shaft 39 is connected to the rotary shaft of the gear 37'. The bearings, sealant, and so forth for the rotary shaft 39 are provided within the boss portion 38.

The rotary shaft 39 of the body portion 21 of the air blower apparatus 20 is mounted on the fan 29 by housing the boss portion 38 of the body portion 21 of the air blower apparatus 20 inside the fan boss 41 of the fan 29.

The inside plate 24 of the body portion 21 of the air blower apparatus 20 is mounted on the mounting plate 31 of the shroud 28, so that the rotary shaft 39 is located at the center of bore of the shroud 28. Thereby, the rotational center of the fan 29 can be located at the center of bore of the shroud 28 when the fan 29 is mounted on the rotary shaft 39 of the body portion 21 of the air blower apparatus 20. Because the rotational center of the fan 29 can be disposed at the inner diameter center of the shroud 28, there is no risk of the outer periphery of the fan 29 contacting the inner surface of the shroud 28 even if the space between the inner surface of the shroud 28 and the outer diameter of the fan 29, in effect the tip clearance t, is small. For this reason, the tip clearance t can be made extremely small. If tip clearance t is large, the air blower apparatus 20 will suffer a high energy loss in the direction of the circumference and reduced blowing efficiency. With the present embodiment, the energy loss in the direction of the circumference becomes small and the blowing efficiency of the air blower apparatus 20 can be improved because tip clearance t can be made small.

The operation of the first embodiment is explained next.

When the engine 11 is driven, pressure oil is discharged from the hydraulic pump 12 and the hydraulic pump 13 for air blower apparatus. The pressure oil discharged from the hydraulic pump 12 is supplied to the outside of the noise proofing chamber 5 via the pipe line 43. The pressure oil discharged from the hydraulic pump 13 for the air blower apparatus is supplied to the hydraulic motor 23 via the pipe line 44. Accordingly, the hydraulic motor 23 rotates.

When the hydraulic motor 23 rotates, power is transmitted from the gears 37, 37' of the hydraulic motor 23 to the rotary shaft 39 and the rotary shaft 39 rotates. Accordingly, the fan 29 mounted on the rotary shaft 39 rotates.

When the fan 29 rotates, air is drawn from the air intake opening 10, passing through the radiator 9 and first duct case 15-1, to the fan 29. The air drawn by the fan 29 passes through the second duct case 15-2 and blows on the engine 11, hydraulic pump 12, and hydraulic pump 13 for air blower apparatus. The air in the engine chamber 8 is exhausted from the air exhaust outlet 14. The location of the air exhaust outlet 14 is determined such that the air passing through the second duct case 15-2 and reaching the engine 11 can be exhausted. The size and number of air exhaust outlets 14 is determined based on the quantity of air discharged from the second duct case 15-2, the sizes of the engine 11, hydraulic pump 12, and hydraulic pump 13 for air blower apparatus, and the structure around the noise proofing chamber 5.

With the first embodiment, the fan 29 is mounted on the rotary shaft 29 by housing the central portion of the body portion of the air blower apparatus where the hydraulic motor 23 is mounted, meaning the boss portion 38, within the fan boss 41 of the fan 29, as shown in FIG. 2. Accordingly, the width of the air blower apparatus 20 in the direction of the rotary shaft 39 can be made small. The space necessary for the air blower apparatus 20 also can be made small because the width of the air blower apparatus 20 in the direction of the rotary shaft becomes small.

Moreover, with the first embodiment, the hydraulic motor 23 is mounted on the body portion 21 of the air blower apparatus 20 as shown in FIG. 2, so as to lie substantially within the total width of the width of the body portion 21 of the air blower apparatus 20 in the direction of the rotary shaft, when the rotary shaft 39 of the body portion 21 of the air blower apparatus 20 is mounted on the fan 29, and the width W of the fan 29 in the direction of the rotary shaft. Because the hydraulic motor 23 is mounted so as to lie within the body portion 21 of the air blower apparatus 20, the space necessary for the air blower apparatus 20 also can be made small.

Also, with the first embodiment, the fan 29 is housed within the shroud 28 and the body portion 21 of the air blower apparatus 20 is fixed to the inner walls of the shroud 28 as shown in FIG. 2. In other words, the blowing efficiency of the air blower apparatus 20 is improved because the fan 29 can be caused to rotate within the shroud 28. Because the body portion 21 of the air blower apparatus 20 is fixed to the inner walls of the shroud 28, the air blower apparatus 20 can be securely fixed inside the shroud 28.

The second embodiment is explained next.

Figure 5:
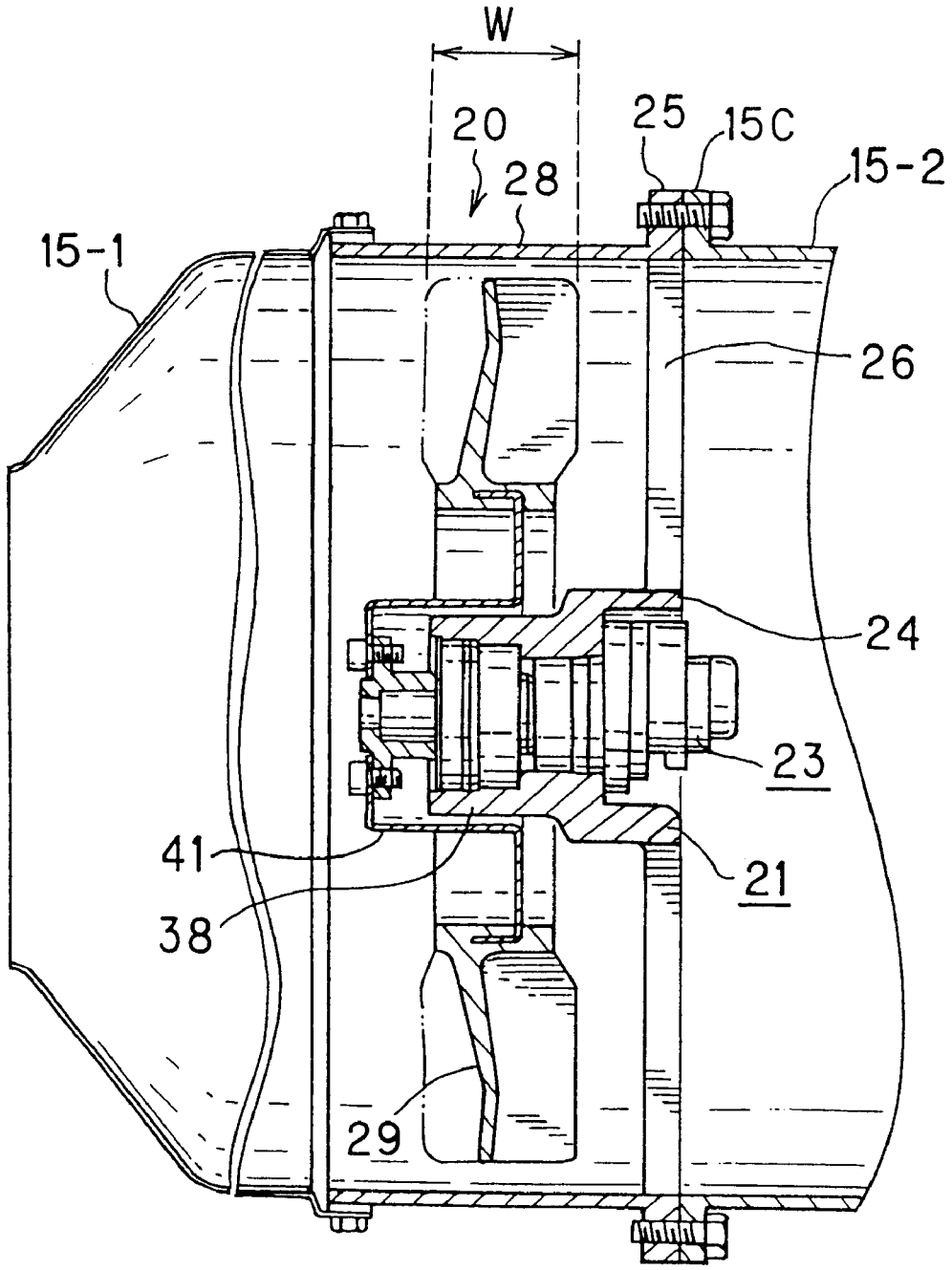
FIG. 5 is a cross sectional view of the air blower apparatus according to the second embodiment.

FIG. 5 is a cross sectional view of the air blower apparatus 20 according to the second embodiment. FIG. 5 corresponds to FIG. 2.

As shown in FIG. 5, the outside plate 25 of the body portion 21 of the air blower apparatus 20 and shroud 28 are formed as one piece. The outer periphery of the outside plate 25 of the body portion 21 of the air blower apparatus 20 is formed as a flange. The flange 15C of the second duct case 15-2 is attached by bolts to the flange-shaped outside plate 25 on the outer periphery of the body portion 21 of the air blower apparatus 20. As above, the second duct case 15-2 is connected to the shroud 28 and the body portion 21 of the air blower apparatus 20 is formed as one piece with the inner walls of the shroud 28.

The fan boss 41 is provided on the rotational center portion of the fan 29. The fan boss 41 projects in the form of a cylinder towards the first duct case 15-1 side and is recessed towards the second duct case 15-2 side.

The hydraulic motor 23 is mounted on the central portion of the body portion 21 of the air blower apparatus 20. The hydraulic motor 23 is mounted on the body portion 21 of the air blower apparatus 20 from the second duct case 15-2 side.

The boss portion 38 is formed on the inside plate 24. The boss portion 38 is formed to project toward the first duct case 15-1 side so as to be contained in the recessed fan boss 41. The boss portion 38 is formed on the central portion of the body portion 21 of the air blower apparatus 20 where the hydraulic motor 23 is mounted.

The rotary shaft 39 of the fan 29 is provided rotatably on the boss portion 38. The rotary shaft 39 is connected to the output shaft of the hydraulic motor 23.

The rotary shaft 39 of the body portion 21 of the air blower apparatus 20 is mounted on the fan 29 by housing the boss portion 38 of the body portion 21 of the air blower apparatus 20 inside the fan boss 41 of the fan 29.

Consequently, as in the first embodiment, when the engine 11 is driven, pressure oil is discharged from the hydraulic pump 13 for air blower apparatus and the hydraulic motor 23 is rotated thereby. When the hydraulic motor 23 rotates, the rotary shaft 39 of the body portion 21 of the air blower apparatus 20 rotates and the fan 29 mounted on the rotary shaft 39 rotates accordingly.

With the second embodiment, as with the first embodiment, the fan 29 is mounted on the rotary shaft 39 by housing the central portion of the body portion 21 of the air blower apparatus 20 where the hydraulic motor 23 is mounted, in effect the fan boss 38, within the fan boss 41 of the fan 29. Accordingly, the width of the air blower apparatus 20 in the direction of the rotary shaft 39 can be made small. The space necessary for the air blower apparatus 20 also can be made small because the width of the air blower apparatus 20 in the direction of the rotary shaft becomes small.

Moreover, with the second embodiment, the hydraulic motor 23 is mounted on the body portion 21 of the air blower apparatus 20 as shown in FIG. 5, so as to lie substantially within the total width of the width of the body portion 21 of the air blower apparatus 20 in the direction of the rotary shaft, when the rotary shaft 39 of the body portion 21 of the air blower apparatus 20 is mounted on the fan 29, and the width W of the fan 29 in the direction of the rotary shaft. The space necessary for the air blower apparatus 20 can be made small because the hydraulic motor 23 is mounted so as to lie substantially within the body portion 21 of the air blower apparatus 20.

Also, with the second embodiment, the fan 29 is housed within the shroud 28 and the body portion 21 of the air blower apparatus 20 is formed as a single piece with the shroud 28. In other words, the fan 29 can be caused to rotate within the shroud 28 and therefore the blowing efficiency of the air blower apparatus 20 is improved. Further, because the body portion 21 of the air blower apparatus 20 is formed as one piece with the inner walls of the shroud 28, the air blower apparatus 20 can be securely fixed inside the shroud 28.

The third embodiment is explained next.

Figure 6:
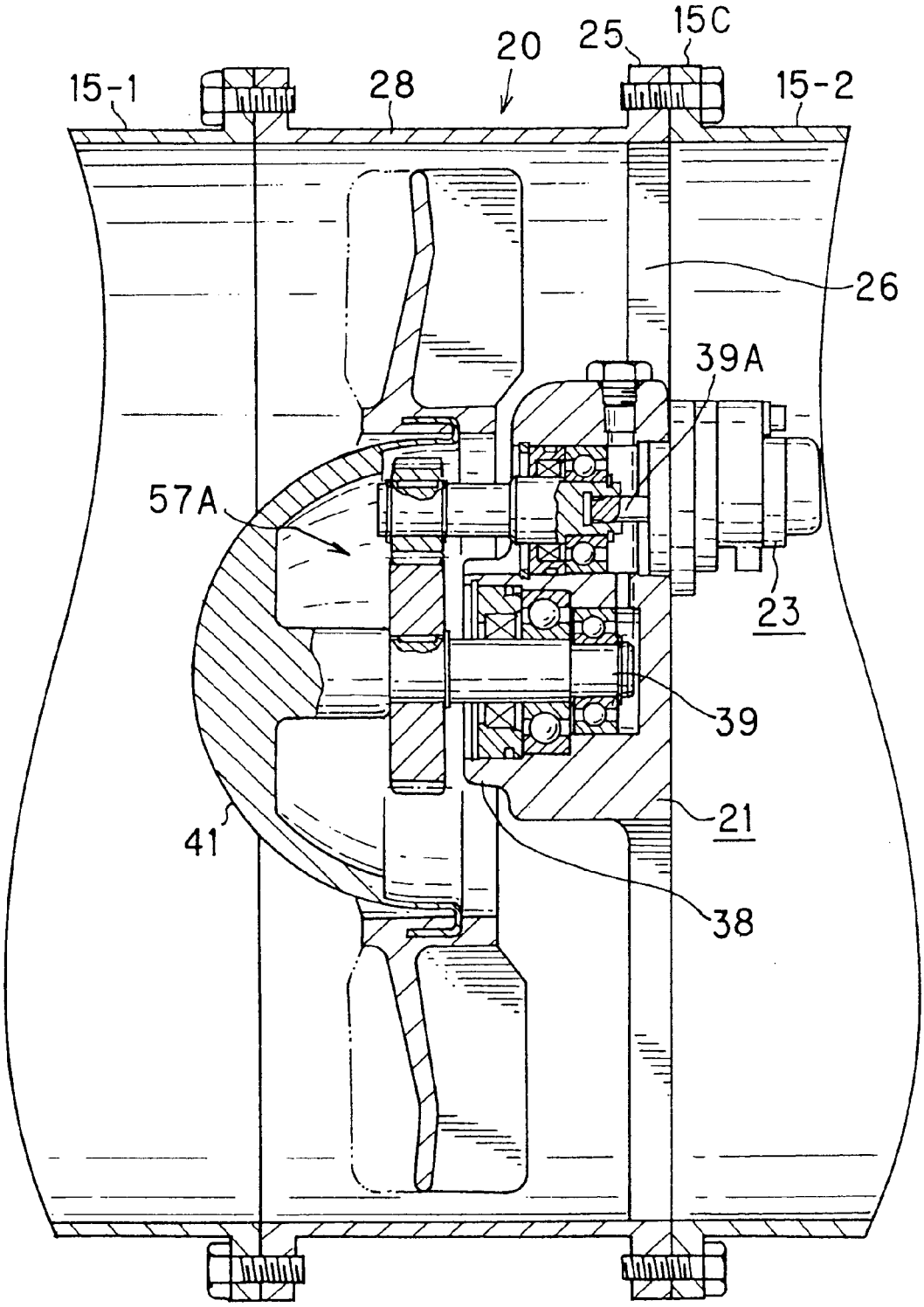
FIG. 6 is a cross sectional view of the air blower apparatus according to the third embodiment.

FIG. 6 is a cross sectional view of the air blower apparatus 20 according to the third embodiment. FIG. 6 corresponds to FIG. 2.

As shown in FIG. 6, the outside plate 25 of the body portion 21 of the air blower apparatus 20 and shroud 28 are formed as one piece. The outer periphery of the outside plate 25 of the body portion 21 of the air blower apparatus 20 is formed as a flange. The flange 15C of the second duct case 15-2 is attached by bolts to the flange-shaped outside plate 25 on the outer periphery of the body portion 21 of the air blower apparatus 20. As above, the second duct case 15-2 is connected to the shroud 28 and the body portion 21 of the air blower apparatus 20 is formed as one piece with the inner walls of the shroud 28.

The fan boss 41 is provided on the rotational center portion of the fan 29. The fan boss 41 projects towards the first duct case 15-1 side and is recessed towards the second duct case 15-2 side.

Moreover, the fan boss 41 is formed to function as a spinner. By forming the fan boss 41 as a spinner, the resistance to the suction air drawn through the first duct case 15-1 by the fan 29 can be made lower.

The hydraulic motor 23 is mounted on the body portion 21 of the air blower apparatus 20. The hydraulic motor 23 is mounted on the body portion 21 of the air blower apparatus 20 from the second duct case 15-2 side.

The power transmission device 57A for transmitting power from the output shaft 39A of the hydraulic motor 23 to the rotary shaft 39 is provided on the body portion 21 of the air blower apparatus 20. The power transmission device 57A is provided on the first duct case 15-1 side of the body portion 21 of the air blower apparatus 20. The power transmission device 57A is a geared transmission, for example, and can be either a speed increasing or decreasing device with changes to the diameters of the master gears and slave gears. Moreover, power may be transmitted with belts instead of gears.

The boss portion 38 is formed on the inside plate 24. The boss portion 38 is formed on the central portion of the body portion 21 of the air blower apparatus 20 so as to project towards the first duct case 15-1 side. The rotary shaft 39 of the fan 29 is provided rotatably on the boss portion 38. The power transmission device 57A is connected to the rotary shaft 39. The power transmission device 57A and the boss portion 38 are formed to project towards the first duct case 15-1 side so as to be housed within the recessed fan boss 41.

The rotary shaft 39 of the body portion 21 of the air blower apparatus 20 is mounted on the fan 29 by housing the power transmission device 57A and the boss portion 38 of the body portion 21 of the air blower apparatus 20 inside the fan boss 41 of the fan 29.

Consequently, as in the first embodiment, when the engine 11 is driven, pressure oil is discharged from the hydraulic pump 13 for air blower apparatus and the hydraulic motor 23 is rotated thereby. When the hydraulic motor 23 rotates, the rotary shaft 39 of the body portion 21 of the air blower apparatus 20 rotates and the fan 29 mounted on the rotary shaft 39 rotates accordingly.

With this third embodiment, the fan 29 is mounted on the rotary shaft 39 by housing the power transmission device 57A and boss portion 38 of the body portion 21 of the air blower apparatus 20 within the fan boss 41 of the fan 29. Accordingly, the width of the air blower apparatus 20 in the direction of the rotary shaft 39 can be made small. In effect, the width of the air blower apparatus 20 in the direction of the rotary shaft 39 can be made small because the power transmission device 57*a,* such as a transmission, that usually requires some space can be housed within the fan boss 41. The space necessary for the air blower apparatus 20 can therefore be made small because the width of the air blower apparatus 20 in the direction of the rotary shaft becomes small.

Also, with the third embodiment, the fan 29 is contained within the shroud 28 and the body portion 21 of the air blower apparatus 20 is formed as a single piece with the shroud 28, as shown in FIG. 6. In other words, the fan 29 can be caused to rotate within the shroud 28 and therefore the blowing efficiency of the air blower apparatus 20 is improved. Also, the air blower apparatus 20 can be securely fixed within the shroud 28 because the body portion 21 of the air blower apparatus 20 and the inner walls of the shroud 28 are formed as a single piece.

The fourth embodiment is explained next.

Figure 7:
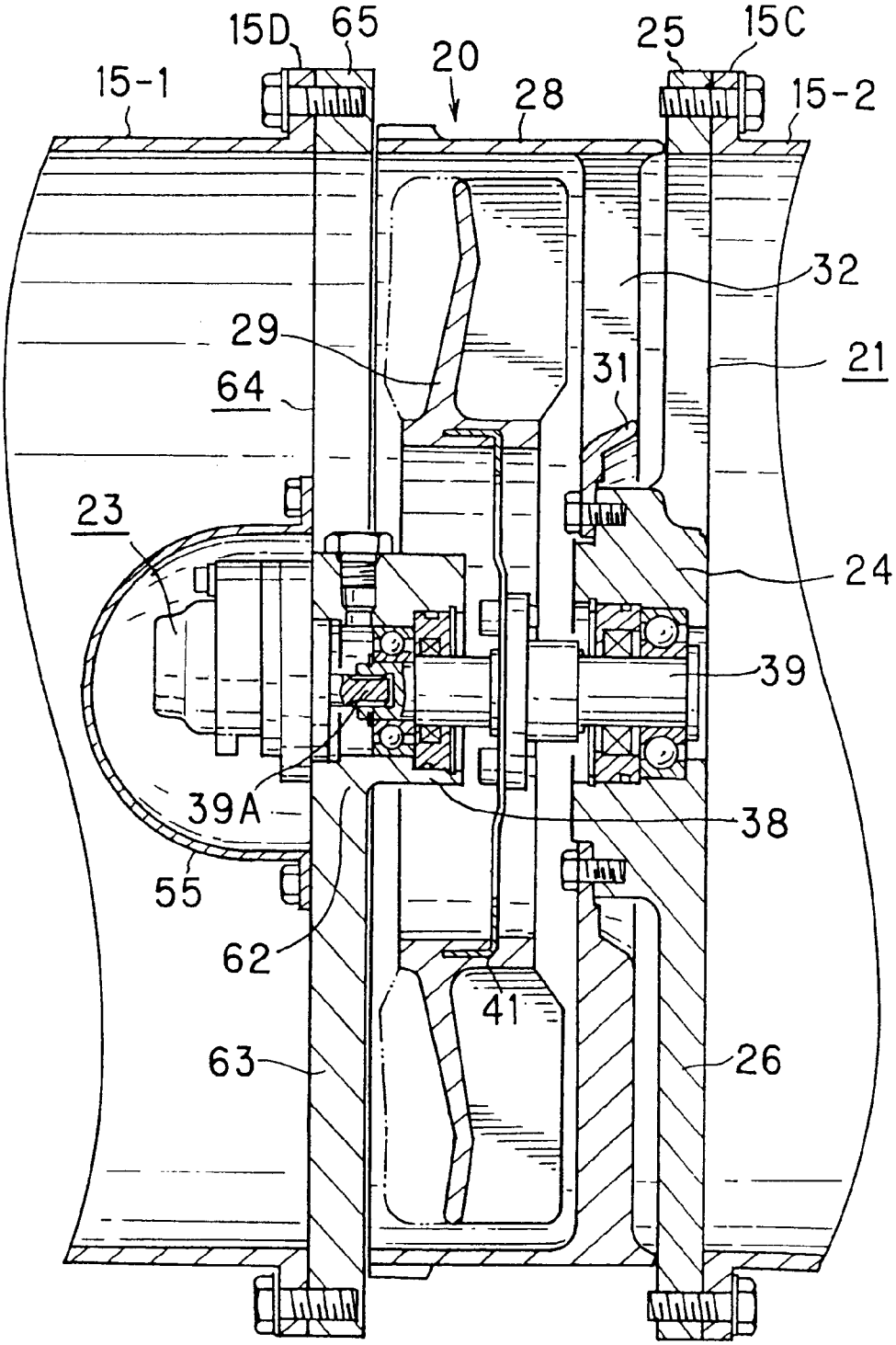
FIG. 7 is a cross sectional view of the air blower apparatus according to the fourth embodiment.
Figure 8:
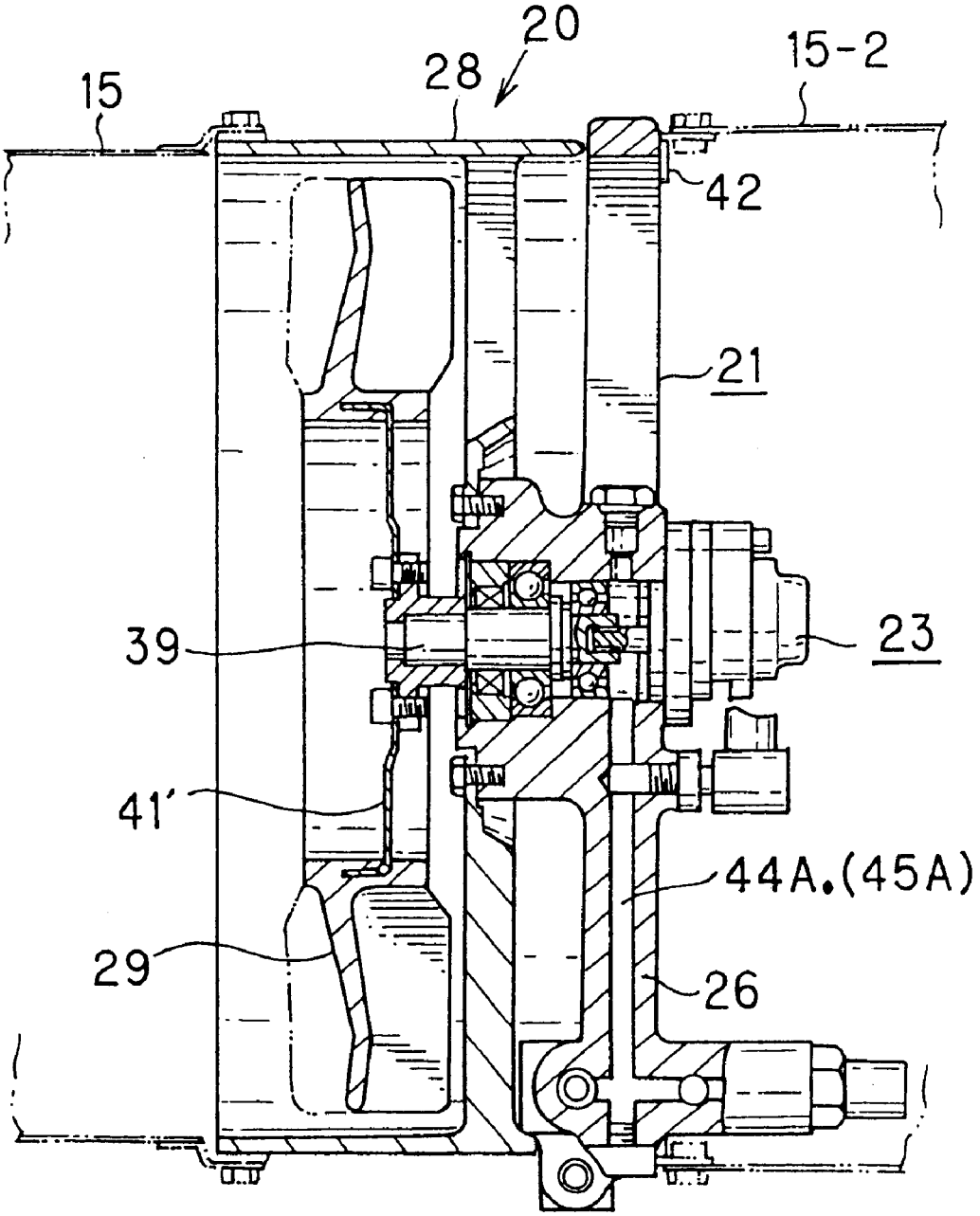
FIG. 8 is a cross sectional view of a conventional air blower apparatus.

FIG. 7 is a cross sectional view of the air blower apparatus 20 according to the fourth embodiment. FIG. 7 corresponds to FIG. 2.

In the first through third embodiments, the body portion 21 of the air blower apparatus 20 is formed as a single piece. In the fourth embodiment shown in FIG. 7, however, the body portion is divided into the body portion 21 and body portion 64.

The body portion 21 is constituted with the disk-shaped inside plate 24 and ring-shaped outside plate 25 connected integrally by a plurality of radial ribs 26, like in FIG. 3. The inside plate 24 of the body portion 21 is fixed by bolts 40 to the mounting plate 31 of the shroud 28.

The outer periphery of the outside plate 25 of the body portion 21 is in the form of a flange. The flange 15C of the second duct case 15-2 is attached by bolts to the flange-shaped outside plate 25 on the outer periphery of the body portion 21.

One end of the rotary shaft 39 of the fan 29 is supported rotatably in the central portion of the body portion 21 of the air blower apparatus 20.

The body portion 64 of the air blower apparatus 20 is formed in the same way as the body portion 21 of the air blower apparatus 20. Specifically, like in FIG. 3, the body portion 64 is constituted with the disk-shaped inside plate 62 and ring-shaped outside plate 65 being connected with a plurality of radial ribs 63. The outside of the outside plate 65 of the body portion 64 is in the form of a flange. The flange 15D of the first duct case 15-1 is fixed by bolts to the flange-shaped outside plate 65 on the outer periphery of the body portion 64 of the air blower apparatus 20.

The other end of the rotary shaft 39 of the fan 29 is supported rotatably in the central portion of the inside plate 62 of the body portion 21.

As above, the first duct case 15-1 and second duct case 15-2 are connected to the shroud 28, and the body portions 21 and 64 of the air blower apparatus 20 are fixed to the inside walls of the shroud 28.

The fan boss 41 is provided on the rotational center portion of the fan 29. The fan boss 41 projects in the form of a cylinder toward the second duct case 15-2 and is recessed towards the first duct case 15-1.

The hydraulic motor 23 is mounted on the central portion of the inside plate 62 of the body portion 64. The hydraulic motor 23 is mounted on the body portion 64 of the air blower apparatus 20 from the first duct case 15-1 side. A spinner 55 is provided on the inside plate of the body portion 64 so as to cover the hydraulic motor 23. The spinner 55 is provided on the body portion 64 so as to project towards the first duct case 15-1 side. The spinner 55 functions to reduce the resistance to the suction drawn through the first duct case 15-1 by the fan 29.

The boss portion 38 is formed on the inside plate 62 of the body portion 64. The boss portion 38 is formed to project towards the second duct case 15-2 side so as to be contained within the recessed fan boss 41. The boss portion 38 is formed in the central portion of the body portion 64 of the air blower apparatus 20 where the hydraulic motor 23 is mounted.

The rotary shaft 39 of the fan 29 is provided on the center of the boss portion 38. The output shaft 39A of the hydraulic motor 23 is disposed at the center of the boss portion 38. In effect, the rotary shaft 39 is coaxial with the output shaft 39A of the hydraulic motor 23 and the rotary shaft 39 is connected to the output shaft 39A.

The rotary shaft 39 is mounted on the fan 29 by housing the boss portion 38 of the body portion 64 within the fan boss 41 of the fan 29.

Consequently, as in the first embodiment, when the engine 11 runs, pressure oil is discharged from the hydraulic pump 13 for the air blower apparatus and the hydraulic motor 23 is rotated thereby. When the hydraulic motor 23 rotates, the rotary shaft 39 of the body portion 21 rotates and the fan 29 mounted on the rotary shaft 39 rotates accordingly.

With the fourth embodiment, like the first embodiment, the fan 29 is mounted on the rotary shaft 39 by housing the central portion of the body portion 64 where the hydraulic motor 23 is mounted, in effect the boss portion 38, within the fan boss 41 of the fan 29. Accordingly, the width of the air blower apparatus 20 in the direction of the rotary shaft 39 can be made small. The space necessary for the air blower apparatus 20 can be made small because the width of the air blower apparatus 20 in the direction of the rotary shaft becomes small.

Also, with the fourth embodiment, the fan 29 is contained within the shroud 28 and the body portions 21 and 64 are formed in the shroud 28, as shown in FIG. 7. In other words, the blowing efficiency of the air blower apparatus 20 is improved because the fan 29 can be caused to rotate within the shroud 28. Also, the air blower apparatus 20 can be securely attached within the shroud 28 because the body portions 21 and 64 of the air blower apparatus 20 are fixed to the shroud 28.

What is claimed is:

1. An air blower apparatus comprising a hydraulic motor and a body portion provided with a rotary shaft, the hydraulic motor being mounted on the rotary shaft, the rotary shaft on which the hydraulic motor is mounted being mounted on a fan, whereby the fan is rotated by driving the hydraulic motor, wherein, a duct for passing air is provided;

a shroud is formed by alienating an outer peripheral of the fan from an inner peripheral of part of the duct;

the fan is housed in the shroud, and the fan and the body of the air blower apparatus are disposed so as to partially overlap each other in the direction of the rotary shaft, making width of the air blower apparatus in the direction of the rotary shaft less than total of width of the body portion of the air blower apparatus in the direction of the rotary shaft and width of the fan in the direction of the rotary shaft.

2. An air blower apparatus comprising a hydraulic motor and a body portion provided with a rotary shaft, the hydraulic motor being mounted on the rotary shaft, the rotary shaft on which the hydraulic motor is mounted being mounted on a fan, whereby the fan is rotated by driving the hydraulic motor, wherein a rotational center portion of the fan is formed with a recess, a substantially central part of the body portion of the air blower apparatus is formed into a projection to be housed in the recess, and the rotary shaft of the body portion of the air blower is mounted on the fan by housing the projection of the body portion of the air blower apparatus in the recess of the fan in such a manner than the projection of the body portion of the air blower apparatus is alienated from the recess of the fan.

3. The air blower apparatus according to claim 2, wherein the hydraulic motor is mounted substantially in the central part of the body portion of the air blower apparatus.

4. The air blower apparatus according to claim 2, wherein the hydraulic motor is mounted on the body portion of the air blower apparatus, so as to lie substantially within a total width of the body portion of the air blower apparatus in the direction of the rotary shaft and width of the fan in the direction of the rotary shaft, when the rotary shaft of the body portion of the air blower apparatus is mounted on the fan.

5. The air blower apparatus according to claim 2, wherein a power transmission device is provided on the body portion of the air blower apparatus so as to transmit power of the hydraulic motor to the rotary shaft.

6. The air blower apparatus according to claim 2, wherein the fan is contained within a shroud, the body portion of the air blower apparatus being fixed to an inner wall of the shroud.

7. An air blower apparatus comprising a hydraulic motor and a body portion provided with a power transmission device for transmitting power of the hydraulic motor to a rotary shaft of the body portion, the hydraulic motor being mounted on the power transmission device; the rotary shaft of the body portion which the hydraulic motor is mounted on being mounted on a fan, whereby the fan is rotated by driving the hydraulic motor, wherein a rotational center portion of the fan is formed with a recess, a part of the body portion of the air blower apparatus, where the power transmission device is provided, is formed into a projection to be housed in the recess, and the rotary shaft of the body portion of the air blower apparatus is mounted on the fan by the projection of the body portion of the air blower apparatus within the recess of the fan in such a manner that the projection of the body portion of the air blower apparatus is alienated from the recess of the fan.

8. An air blower apparatus comprising a hydraulic motor and a body portion provided with a rotary shaft, the hydraulic motor being mounted on a rotary shaft, the rotary shaft on which the hydraulic motor is mounted being mounted on a fan, whereby the fan is rotated by driving the hydraulic motor, wherein a duct for passing air is provided, a shroud is formed by alienating an outer peripheral of the fan from an inner peripheral of part of the duct, the fan is accommodated in the shroud, a substantially central part of the body portion of the air blower apparatus is formed into a projection to be housed in the recess, whereby the rotary shaft of the body portion of the air blower apparatus is mounted on the fan by housing the projection of the body portion of the air blower apparatus in the recess of the fan.

9. An air blower apparatus comprising a hydraulic motor and a body portion provided with a power transmission device for transmitting power of the hydraulic motor to a rotary shaft of the body portion, the hydraulic motor being mounted on the power transmission device; the rotary shaft of the body portion which the hydraulic motor is mounted on being mounted on a fan, whereby the fan is rotated by driving the hydraulic motor, wherein a duct for passing air is provided, a shroud is formed by alienating an outer peripheral of the fan from an inner peripheral of part of the duct, the fan is accommodated in the shroud, a rotational center portion of the fan is formed with a recess, a part of the body portion of the air blower apparatus, where the power transmission device is provided, is formed into a projection to be housed in the recess, and the rotary shaft of the body portion of the air blower apparatus is mounted on the fan by housing the projection of the body portion of the air blower apparatus within the recess of the fan.

* * * * *